US012109476B2

(12) United States Patent
Lewis, Jr.

(10) Patent No.: US 12,109,476 B2
(45) Date of Patent: Oct. 8, 2024

(54) SUSPENDED MOUNTING AND EXERCISE APPARATUS AND METHODS OF USING SAME

(71) Applicant: Leo Nelson Lewis, Jr., Leesville, SC (US)

(72) Inventor: Leo Nelson Lewis, Jr., Leesville, SC (US)

( * ) Notice: Subject to any disclaimer, the term of this patent is extended or adjusted under 35 U.S.C. 154(b) by 347 days.

(21) Appl. No.: 16/906,058

(22) Filed: Jun. 19, 2020

(65) Prior Publication Data

US 2020/0398096 A1 Dec. 24, 2020

Related U.S. Application Data

(60) Provisional application No. 62/863,703, filed on Jun. 19, 2019.

(51) Int. Cl.

| | |
|---|---|
| ***A47H 1/10*** | (2006.01) |
| ***A63B 7/00*** | (2006.01) |
| ***A63B 9/00*** | (2006.01) |
| ***E04B 9/00*** | (2006.01) |

(52) U.S. Cl.
CPC ..... *A63B 7/00* (2013.01); *A63B 9/00* (2013.01); *E04B 9/006* (2013.01)

(58) Field of Classification Search
CPC ..... A63B 7/00; A63B 9/00; F16M 13/027; E04B 9/006
USPC ..... 248/317, 343
See application file for complete search history.

(56) References Cited

U.S. PATENT DOCUMENTS

| | | | | |
|---|---|---|---|---|
| 3,436,047 | A * | 4/1969 | Foltz | A47H 1/104 104/111 |
| 2004/0048723 | A1* | 3/2004 | Parrilla | A63B 71/0036 482/93 |
| 2009/0188197 | A1* | 7/2009 | Irizarry | E04B 9/006 52/655.1 |
| 2013/0312360 | A1* | 11/2013 | Wallther | B23P 15/00 403/205 |

FOREIGN PATENT DOCUMENTS

| | | | |
|---|---|---|---|
| WO | 00/22248 | A1 | 4/2000 |

* cited by examiner

*Primary Examiner* — Todd M Epps
(74) *Attorney, Agent, or Firm* — Maynard Nexsen PC; Todd A. Serbin

(57) ABSTRACT

A suspended mounting and exercise apparatus suspended from an overhead structure, comprising: a form; and at least one anchoring point comprising a plurality of stalls affixed to the form, wherein the form is affixed to the overhead structure via the at least one anchoring point.

20 Claims, 11 Drawing Sheets

SUSPENDED MOUNTING AND EXERCISE APPARATUS AND METHODS OF USING SAME

RELATED APPLICATIONS

This application claims the benefit of priority under 35 USC § 119(e) of U.S. Provisional Patent Application No. 62/863,703, filed Jun. 19, 2019, the contents of which are incorporated herein by reference in their entirety.

FIELD AND BACKGROUND OF THE INVENTION

The present invention, in some embodiments thereof, relates to the fitness industry and, more particularly, but not exclusively, to fitness apparatuses.

SUMMARY OF THE INVENTION

According to an aspect of some embodiments of the present invention there is provided a suspended mounting and exercise apparatus suspended from an overhead structure, comprising: a form; and at least one anchoring point comprising a plurality of stalls affixed to the form, wherein the form is affixed to the overhead structure via the at least one anchoring point.

In an embodiment of the invention, the apparatus further comprises at least one suspension cable/rod/link between the at least one anchoring point and the overhead structure.

In an embodiment of the invention, the at least one suspension cable/rod/link is connected to the at least one anchoring point affixed to the form and a second anchoring point affixed to the overhead structure.

In an embodiment of the invention, a plurality of suspension cable/rod/links are connected to the at least one anchoring point affixed to the form and the second anchoring point affixed to the overhead structure.

In an embodiment of the invention, the plurality of suspension cable/rod/links are connected to the at least one anchoring point affixed to the form and the second anchoring point affixed to the overhead structure at angles relative to each other.

In an embodiment of the invention, the angles of the plurality of suspension cable/rod/links relative to each other provide multiple axes of reinforcement against movement of the form.

In an embodiment of the invention, the multiple axes are at least partly created by the stalls being positioned in different locations on the at least one anchoring point.

In an embodiment of the invention, the form is constructed of industry-standard rack components.

In an embodiment of the invention, the rack components are 4-sided.

In an embodiment of the invention, the rack components are at least 3 inches by 3 inches.

In an embodiment of the invention, the rack components are 4 inches by 4 inches.

In an embodiment of the invention, each of the rack components are provided with at least one hole therein.

In an embodiment of the invention, the apparatus further comprises at least one Y-connector, T-connector, V-connector, X-connector or end connector, the at least one Y-connector, T-connector, V-connector, X-connector or end connector provided with at least one opening corresponding to the at least one hole in each of the rack components.

In an embodiment of the invention, the apparatus further comprises exercise attachments.

According to a further aspect of some embodiments of the present invention there is provided a method of using a suspended mounting and exercise apparatus, comprising: constructing a form; affixing at least one anchoring point comprising a plurality of stalls to the form and/or an overhead structure; and, connecting the form to the overhead structure using the at least one anchoring point.

In an embodiment of the invention, the method further comprises connecting the form to the over head structure using at least one suspension cable/rod/link.

In an embodiment of the invention, the method further comprises providing exercise attachments to the form.

In an embodiment of the invention, when a plurality of anchoring points are used in combination with a plurality of suspension cable/rod/links, the links connect different anchoring points at varying, optionally opposing, angles.

In an embodiment of the invention, the angles of the plurality of suspension cable/rod/links relative to each other provide multiple axes of reinforcement against movement of the form.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example, are not necessarily to scale, and for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
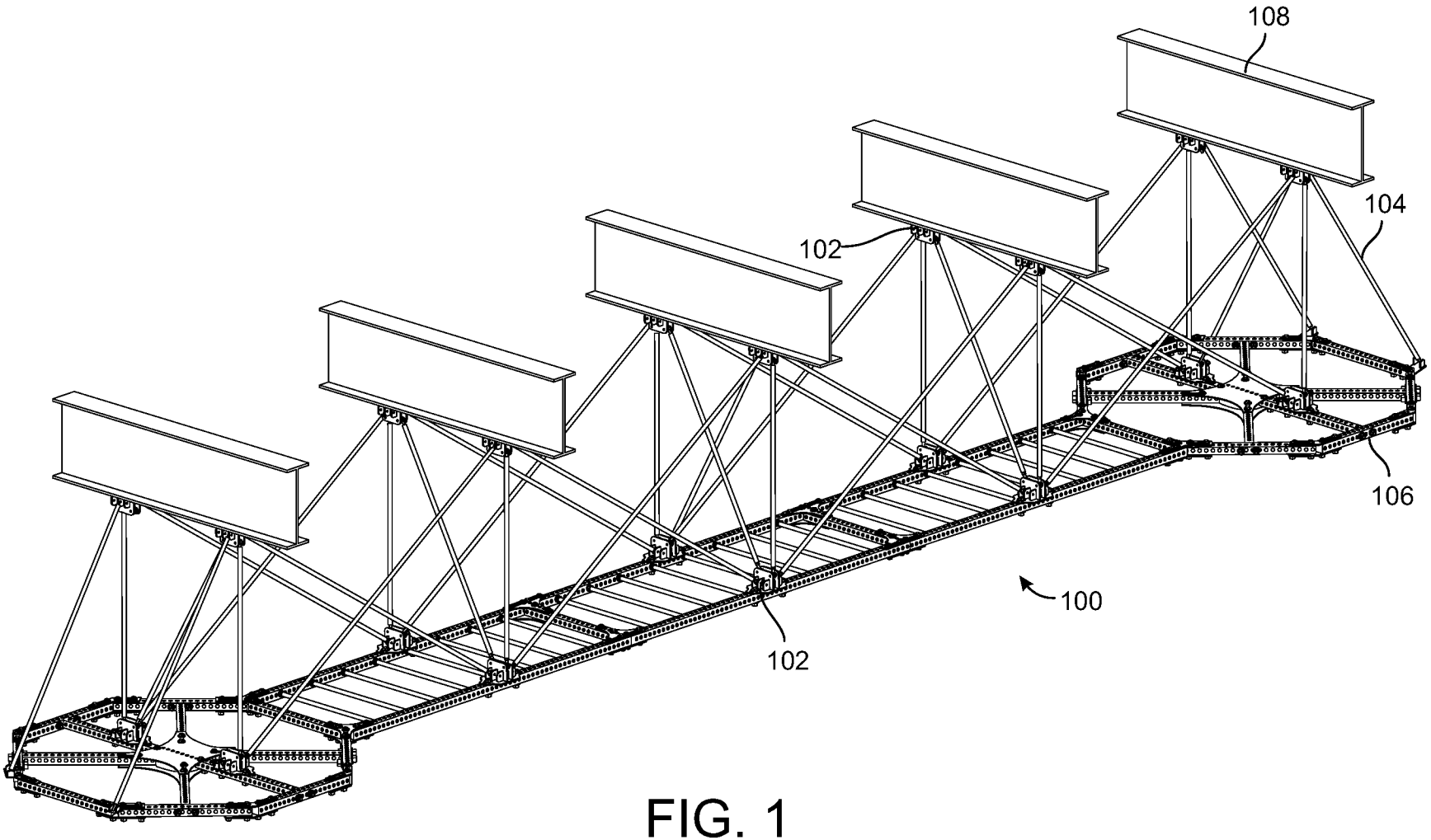
FIG. 1 is a perspective view of a suspended mounting and exercise apparatus.
Figure 2A:
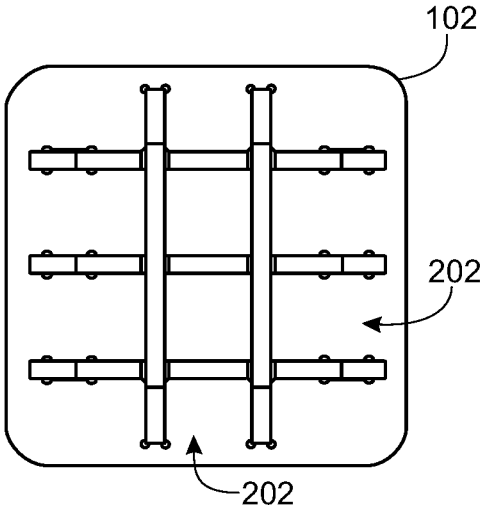
FIGS. 2A-2D are top, perspective, front/back and side views, respectively, of an anchoring point.
Figure 2B:
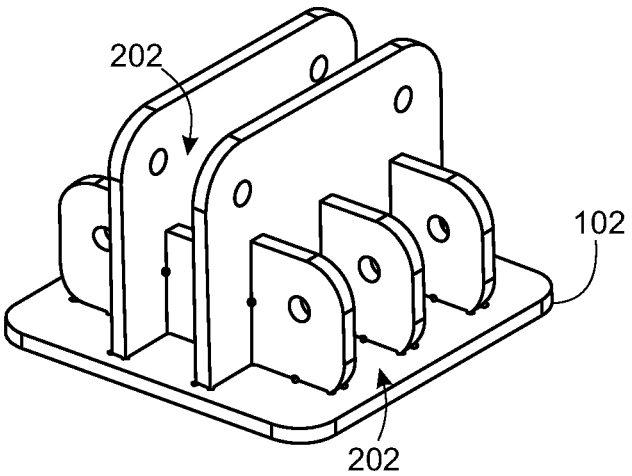
Figure 2C:
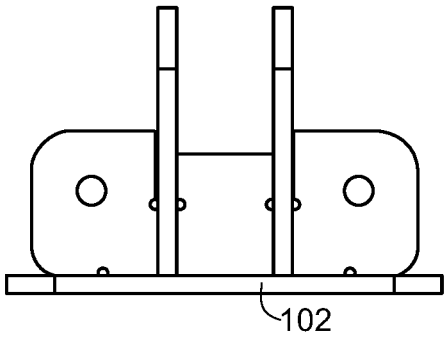
Figure 2D:
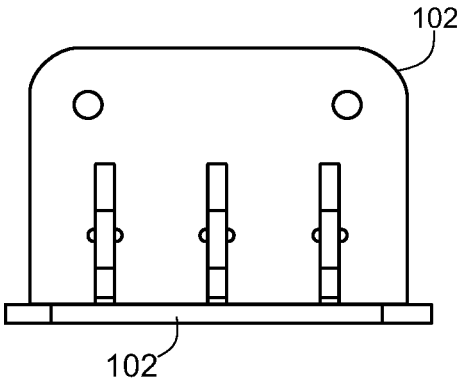

The present invention, in some embodiments thereof, relates to the fitness industry and, more particularly, but not exclusively, to fitness apparatuses.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

FIG. 1 is a perspective view of a suspended mounting and exercise apparatus 100. In an embodiment of the invention, the apparatus 100 comprises at least one anchoring point 102, at least one suspension cable/rod/link 104, and/or some kind of overhead form 106. The apparatus 100 is conventionally mounted to an overhead structure 108, for example shown as I-beams in FIG. 1, but which could be just about any suitable load bearing structure capable of bearing the weight of the apparatus 100, any additional weights and/or fitness attachments and/or users of the apparatus 100.

In an embodiment of the invention, a plurality of anchoring points 102 (as shown and described in more detail with respect to FIGS. 2A-2D and 3) are used to secure the form 106 to an overhead structure 108. Optionally, at least one suspension cable/rod/link 104 is used to connect the form 106 to two opposing anchoring points 102, wherein one anchoring point 102 is attached to the overhead structure 108 and one is attached to the form 106. Optionally, the form 106 is connected directly to the overhead structure 108 using at least one anchoring point 102.

It should be understood that, in an embodiment of the invention, the length of the suspension cable/rod/link 104 is adjustable and/or is configured to place the form 106 into the desired position away from the overhead structure 108 and/or the floor underlying the apparatus 100. It should also be understood that where the suspension cable/rod/link 104 is connected to the form 106 (by moving the anchoring point 102 along the length of the form 106 and/or even by connecting the anchoring point 102 to different sides of the form 106) also reduces or increases the effective vertical length of the suspension cable/rod/link 104, so therefore, the vertical separation between the overhead structure 108 and/or the form 106 and/or the floor could be adjusted in that manner, additionally and/or alternatively and/or optionally.

In some embodiments of the invention, the actual shape of the form 106 is customizable, changeable and/or adaptable to the client's needs and/or the exercises to be carried out with the apparatus 100 and/or to the shape or size of the room in which the apparatus 100 is to be installed. It should be understood that the extended figure 8-like shape for the form 106 shown in FIG. 1 is merely an example of virtually any shape which form 106 could exhibit.

FIGS. 2A-2D are top, perspective, front/back and side views, respectively, of an anchoring point 102. While different anchoring point 102 configurations could be used, this particular configuration is provided with multiple different stalls 202 or niches wherein multiple different suspension cable/rod/links 104 can be attached, and at different angles with respect to the anchoring point 102, and therefore form 106 or overhead structure 108, since the anchoring point 102 is attached to the form 106 or overhead structure 108. In some embodiments of the invention, the positioning of the different stalls 202 on the anchoring point 102 facilitates the creation of the different, sometimes complimentary, sometimes opposing angles of support using the suspension cable/rod/links 104 when the suspension cable/rod/links 104 are attached to or within a certain stall 202. It should be understood that the creation of a particular angle could be influenced depending on which stall 202 on the anchoring point 102 the suspension cable/rod/link 104 is attached. Different angles of attachment are shown in more detail in FIGS. 4 and 5.

Figure 3:
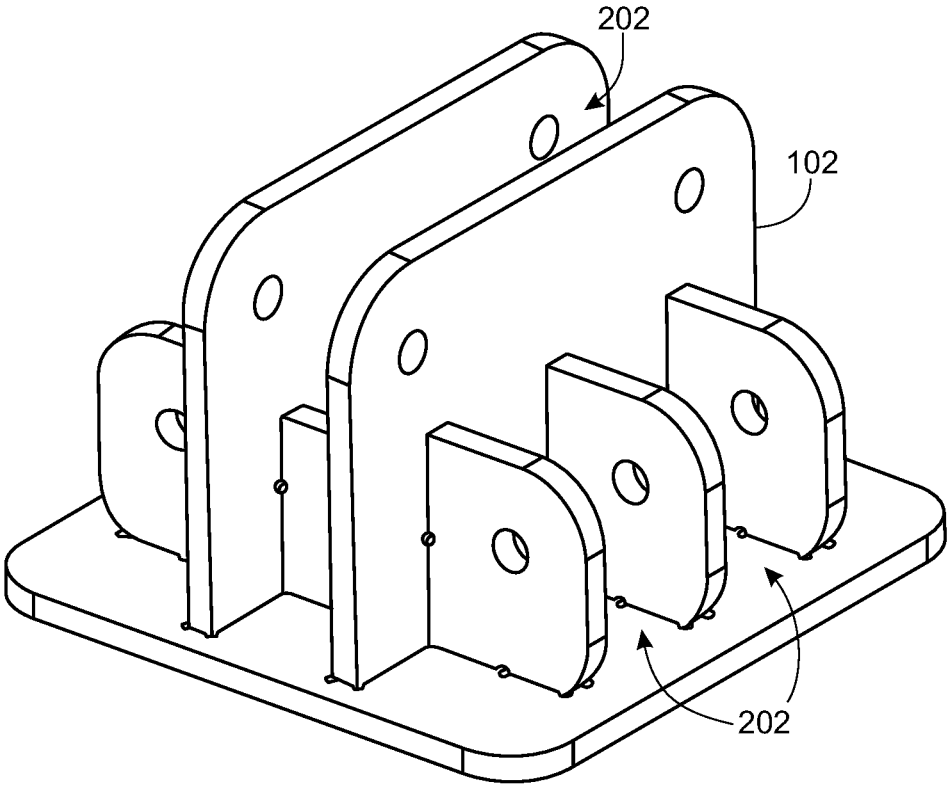
FIG. 3 is a close-up perspective view of an anchoring point.

FIG. 3 is a close-up perspective view of an anchoring point 102.

Figure 4:
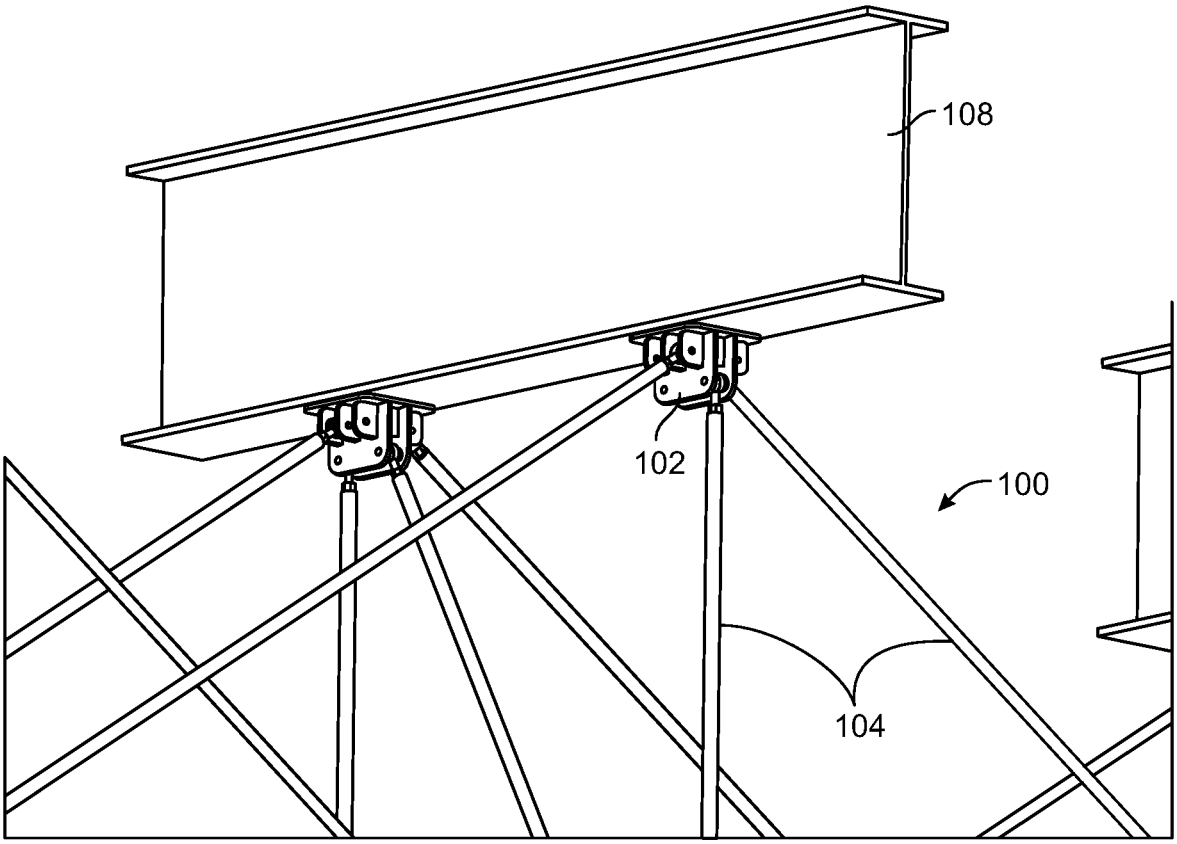
FIG. 4 is a perspective view of an upper portion of a suspended mounting and exercise apparatus.

FIG. 4 is a perspective view of an upper portion of a suspended mounting and exercise apparatus 100 where the apparatus 100 is connected to the overhead structure 108.

Figure 5:
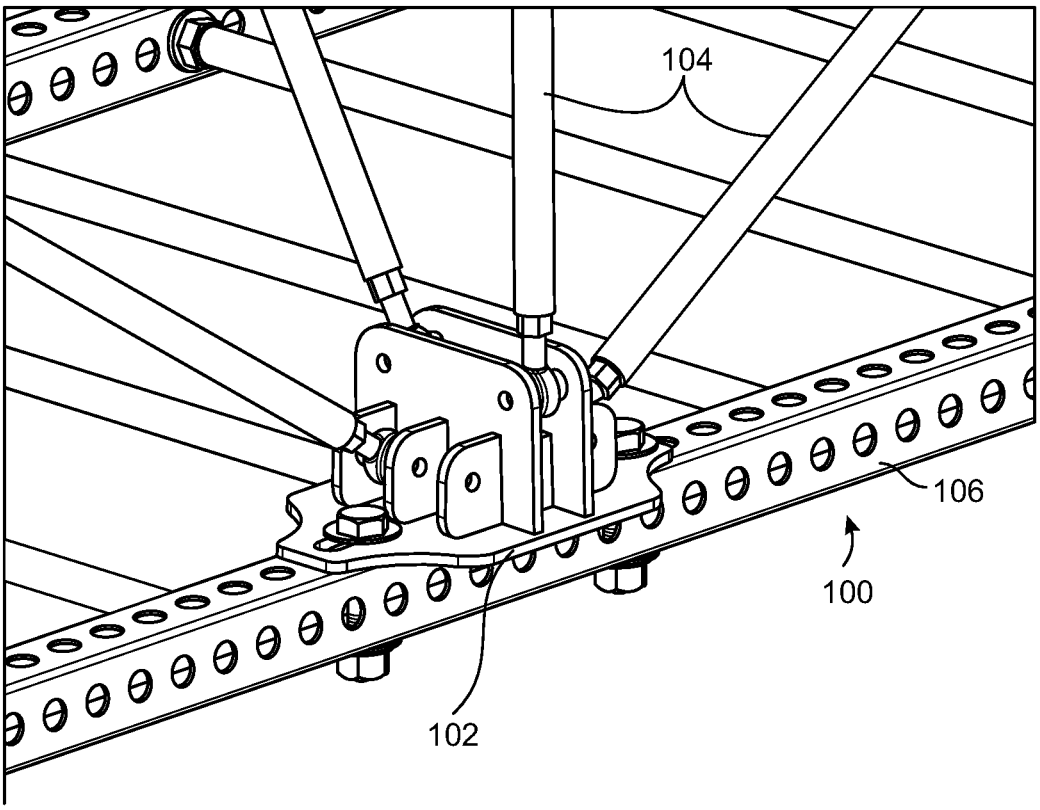
FIG. 5 is a perspective view of a lower portion of a suspended mounting and exercise apparatus.

FIG. 5 is a perspective view of a lower portion of a suspended mounting and exercise apparatus 100, showing in greater detail a feature of the apparatus 100 in that connections/attachment is performed, in an embodiment of the invention, at multiple points and in multiple angles, thereby providing multiple axes of reinforcement against movement of the form 106 while exercises are being conducted on exercise attachments (not shown) connected to the apparatus 100. As can be seen in these FIGS., the angle of the suspension cable/rod/link 104 can also be influenced by attaching the suspension cable/rod/links 104 to the anchoring point 102 at a desired rotational angle. As examples in FIG. 5, one suspension cable/rod/link 104 extends out of the top of the anchoring point in a nearly vertical orientation, whereas the suspension cable/rod/link 104 attached to a side stall is closer to 45 degrees from horizontal. In some embodiments of the invention, a connector is used to connect the suspension cable/rod/link 104 to the stall 202 which is rotatable in configuration, for example being circular in cross-section so that the suspension cable/rod/link 104 can be rotated using the connector as a pivot axis, before the connector is tightened (for example using a threaded screw/bolt and nut arrangement) to prevent motion of the suspension cable/rod/link 104.

In some embodiments of the invention, the form 106, is constructed of conventional rack components, such as the 4-sided and holed bars used to construct the Sorinex® Base Camp™ series, XL™ series, Apex™, or Dark Horse™ racks. Some of these racks are 4 inches by 4 inches (10.2 cm×10.2 cm). Some are 3 inches by 3 inches (7.6 cm×7.6 cm). Any attachment which is compatible with these racks, should therefore, be also compatible with the apparatus 100. In some embodiments of the invention, the form 106 is constructed of any number of rack components of differing lengths, and optionally, differing cross-sectional shapes, and optionally, even curved components, as needed to suit customer requirements and/or the space in which the apparatus 100 will be installed and/or the exercises intended to be conducted with the apparatus 100. In some embodiments of the invention, exercise attachments include any attachments which are compatible with the rack types described above and available from Sorinex Exercise Equipment, Inc. and other fitness companies.

Figure 6:
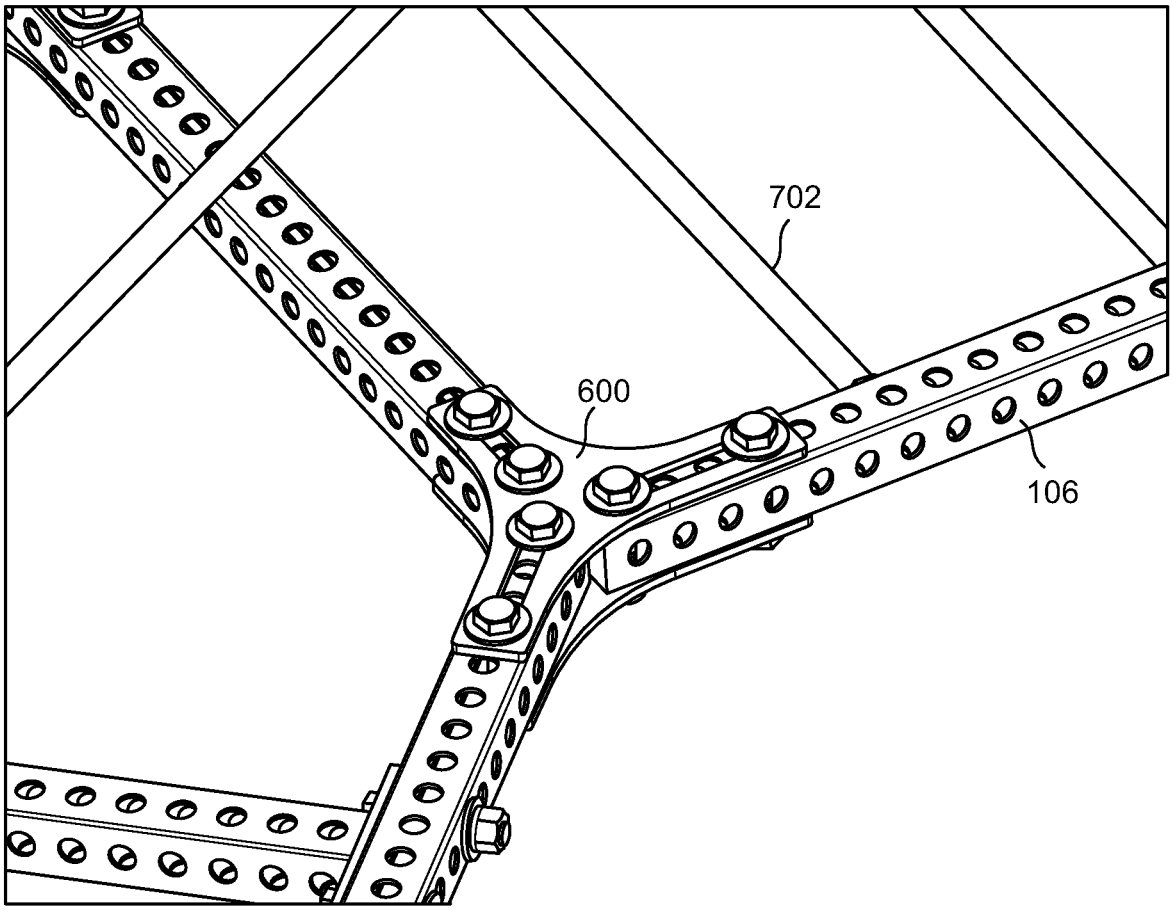
FIG. 6 is a perspective view of a Y-connector.

FIG. 6 is a perspective view of a Y-connector 600 used for connecting different rack components together to construct the form 106.

Figure 7:
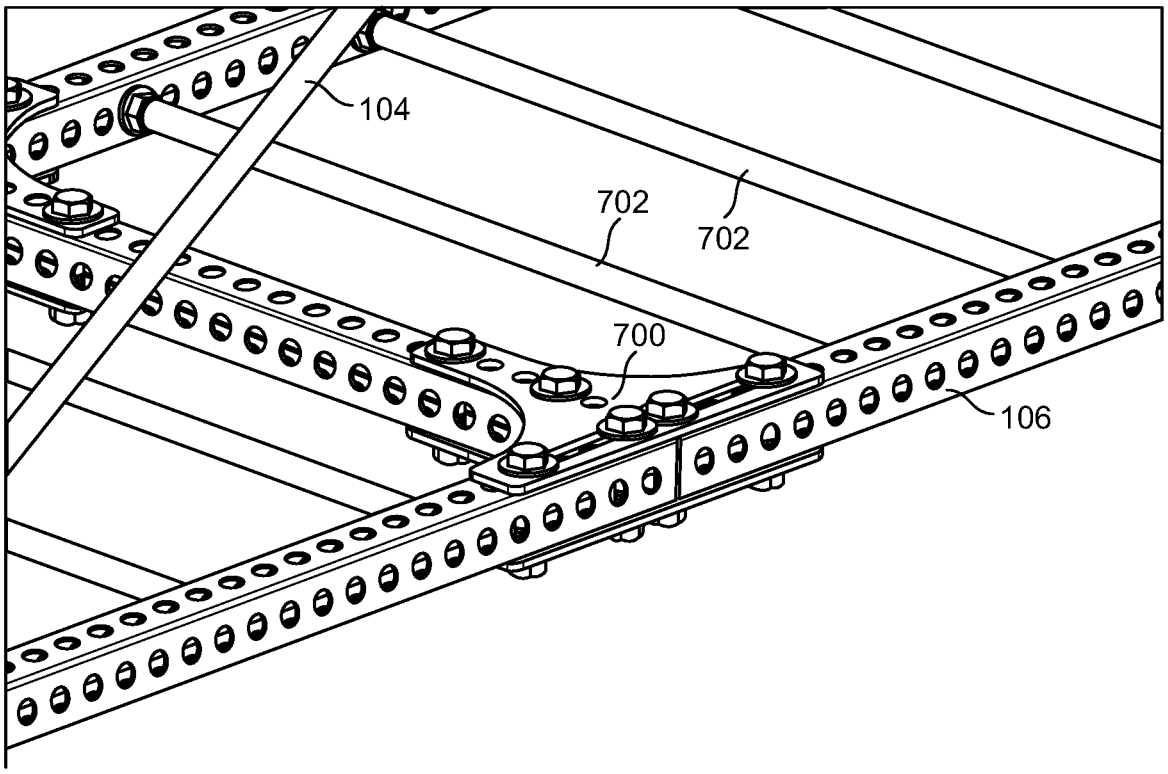
FIG. 7 is a perspective view of a T-connector.

FIG. 7 is a perspective view of a T-connector 700 used for connecting different rack components together to construct the form 106. In some embodiments of the invention, connecting spines 702 are used to reinforce the form 106 and/or to provide additional locations for attachments or other exercise gear, such as straps, bands, rings and the like.

Figure 8:
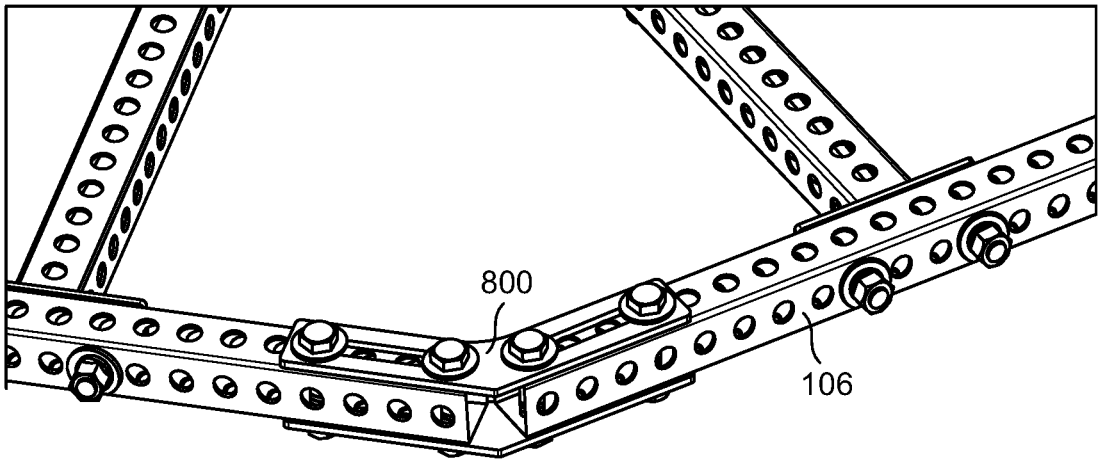
FIG. 8 is a perspective view of a V-connector.

FIG. 8 is a perspective view of a V-connector 800 used for connecting different rack components together to construct the form 106.

Figure 9:
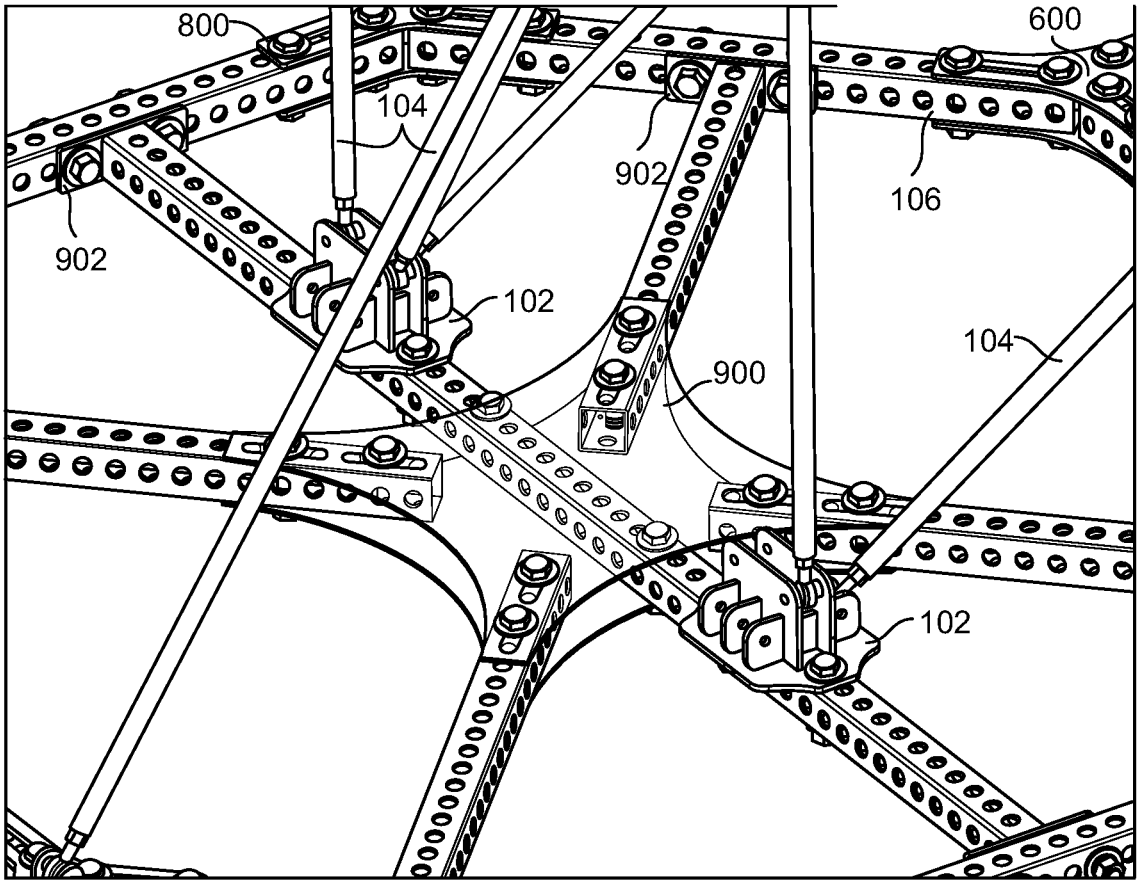
FIG. 9 is perspective, semi-transparent view of an X-connector.
Figure 10:
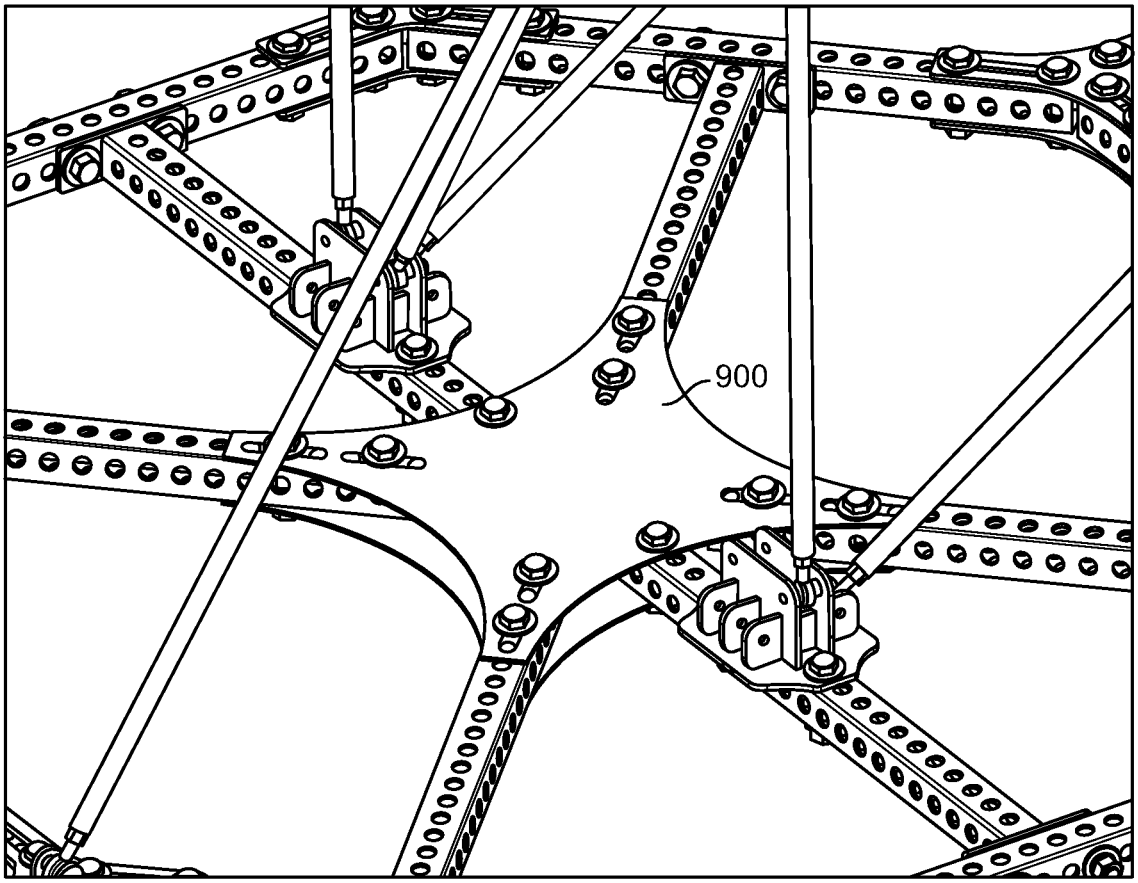
FIG. 10 is perspective view of an X-connector.

FIG. 9 is perspective, semi-transparent view of an X-connector 900 used in the construction of a form 106, wherein a Y-connector 600 and a V-connector 800 are also shown. Also shown in FIG. 9 is an end connector 902 which is used, in an embodiment of the invention, to connect the end of a rack component piece to the side of a rack component piece. FIG. 10 is a solid, perspective view of the X-connector 900. As can be seen in FIGS. 6-10, each connector type is provided with at least one opening, for example a hole or a slot (which allows for variable or multiple connector positioning) for insertion of a connector therethrough. In some embodiments of the invention, the connector is used to connect more than one rack component together. It should be noted that the anchoring point 102 is also provided with at least one hole or slot for connecting it to at least one rack component, suspension cable/rod/link 104 or overhead structure 108. In some embodiments of the invention, a connector is a screw or bolt which is fastenable to and/or through the opening to connect to structural elements together.

Figure 11:
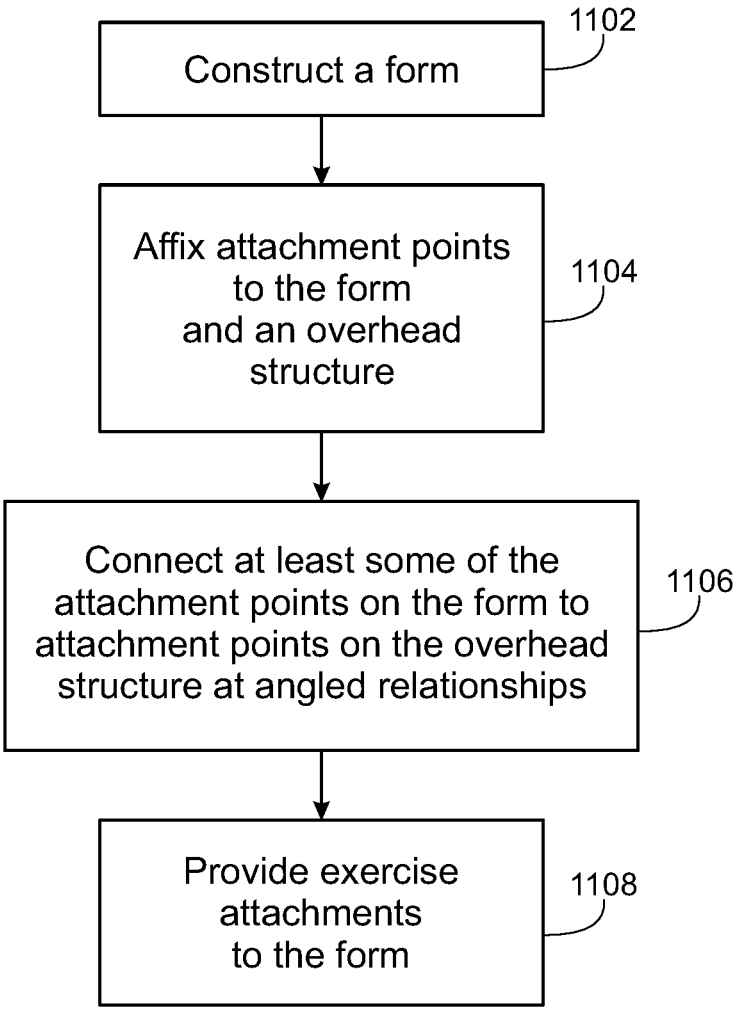
FIG. 11 is a flowchart of a method of using a suspended mounting and exercise apparatus.

FIG. 11 is a flowchart of a method of using a suspended mounting and exercise apparatus 100. As described elsewhere herein, the form 106 can exhibit virtually any shape and, in an embodiment of the invention, is constructed (1102) of rack components of varying lengths, sizes, shapes, cross-sections, and/or curvatures as are desired. Further, different shaped connectors are optionally usable with the rack components to connect 2, 3, 4 or more rack components together in the form, while also providing certain shapes to the connection, for example the Y-shape, T-shape, V-shape and X-shape connections described herein. It should be understood that these are by way of example only, and any number of rack components could be connected together, in virtually any relationship in one, two or three dimensions.

At least one attachment point is affixed (1104), optionally removably, to the form for direct connection to an overhead structure 108 or for connection to at least one suspension cable/rod/link 104, where optionally, a second attachment point 102 is affixed (1104) to the overhead structure 108 and the two attachment points 102 are connected (1106) together by way of the at least one suspension cable/rod/link 104. As described and shown herein, in some embodiments of the invention, a feature of the apparatus 100 is that a plurality of attachment points are used in combination with a plurality of suspension cable/rod/links such that when the links connect different attachment points at varying, optionally opposing, angles, the apparatus 100 as a whole is provided with support against movement of the form 106 during exercise on exercise attachments which are provided (1108) to the form. In an embodiment of the invention, the exercise attachments are connected to the form 106 using the holes in the rack components thereof.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A suspended mounting and exercise apparatus suspended from an overhead structure, comprising:

a form, wherein the form is constructed of industry-standard rack components and wherein each of the rack components are provided with at least one hole therein;

at least one Y-connector, V-connector, or X-connector the at least one Y-connector, V-connector, or X-connector provided with at least one opening corresponding to the at least one hole in each of the rack components; and at least one anchoring point comprising a plurality of stalls affixed to the form, wherein the form is affixed to the overhead structure via the at least one anchoring point, wherein each of the plurality of stalls is open-ended over a rotational range of at least ninety degrees.

2. A suspended mounting and exercise apparatus according to claim 1, further comprising at least one suspension cable/rod/link between the at least one anchoring point and the overhead structure.

3. A suspended mounting and exercise apparatus according to claim 2, wherein the at least one suspension cable/rod/link is connected to the at least one anchoring point affixed to the form and a second anchoring point affixed to the overhead structure.

4. A suspended mounting and exercise apparatus according to claim 3, where a plurality of suspension cable/rod/links are connected to the at least one anchoring point affixed to the form and the second anchoring point affixed to the overhead structure.

5. A suspended mounting and exercise apparatus according to claim 4, where the plurality of suspension cable/rod/links are connected to the at least one anchoring point affixed to the form and the second anchoring point affixed to the overhead structure at angles relative to each other.

6. A suspended mounting and exercise apparatus according to claim 5, wherein the angles of the plurality of suspension cable/rod/links relative to each other provide multiple axes of reinforcement against movement of the form.

7. A suspended mounting and exercise apparatus according to claim 6, wherein the multiple axes are at least partly created by the stalls being positioned in different locations on the at least one anchoring point.

8. A suspended mounting and exercise apparatus according to claim 1, wherein the rack components are 4-sided.

9. A suspended mounting and exercise apparatus according to claim 1, wherein the rack components are at least 3 inches by 3 inches.

10. A suspended mounting and exercise apparatus according to claim 1, wherein the rack components are 4 inches by 4 inches.

11. A suspended mounting and exercise apparatus according to claim 1, further comprising exercise attachments.

12. A suspended mounting and exercise apparatus according to claim 1, further comprising at least one T-connector.

13. A suspended mounting and exercise apparatus according to claim 1, further comprising at least one end connector.

14. A method of using a suspended mounting and exercise apparatus, comprising:

constructing a form, wherein the form is constructed of industry-standard rack components and wherein each of the rack components are provided with at least one hole therein;

at least one Y-connector, V-connector, or X-connector, the at least one Y-connector, V-connector, or X-connector provided with at least one opening corresponding to the at least one hole in each of the rack components;

affixing at least one anchoring point comprising a plurality of stalls to the form and/or an overhead structure, wherein each of the plurality of stalls is open-ended over a rotational range of at least ninety degrees; and, connecting the form to the overhead structure using the at least one anchoring point.

15. The method of using a suspended mounting and exercise apparatus according to claim 14, further comprising connecting the form to the over head structure using at least one suspension cable/rod/link.

16. The method of using a suspended mounting and exercise apparatus according to claim 14, further comprising providing exercise attachments to the form.

17. The method of using a suspended mounting and exercise apparatus according to claim 14, wherein when a plurality of anchoring points are used in combination with a plurality of suspension cable/rod/links, the links connect different anchoring points at varying, optionally opposing, angles.

18. The method of using a suspended mounting and exercise apparatus according to claim 17, wherein the angles of the plurality of suspension cable/rod/links relative to each other provide multiple axes of reinforcement against movement of the form.

19. A method of using a suspended mounting and exercise apparatus according to claim 14, further comprising providing at least one T-connector.

20. A method of using a suspended mounting and exercise apparatus according to claim 14, further comprising providing at least one end connector.

* * * * *